US005639137A

United States Patent [19]

Bakx

[11] Patent Number: 5,639,137

[45] Date of Patent: Jun. 17, 1997

[54] TOP GRIPPING ARTICLE CARRIER

[75] Inventor: Martinus C. M. Bakx, Goes, Netherlands

[73] Assignee: The Mead Corporation, Dayton, Ohio

[21] Appl. No.: 446,763

[22] PCT Filed: Mar. 22, 1995

[86] PCT No.: PCT/US95/03506

§ 371 Date: Jun. 2, 1995

§ 102(e) Date: Jun. 2, 1995

[87] PCT Pub. No.: WO95/25691

PCT Pub. Date: Sep. 28, 1995

[30] Foreign Application Priority Data

Mar. 22, 1994 [GB] United Kingdom ..... 9405674

[51] Int. Cl.[6] ..... B65D 71/00

[52] U.S. Cl. ..... 294/87.2; 206/158

[58] Field of Search ..... 294/87.1, 87.2, 294/87.26, 87.28, 159; 206/139, 141, 145, 147–149, 151–153, 158, 161, 162, 170, 199

[56] References Cited

U.S. PATENT DOCUMENTS

| | | | |
|---|---|---|---|
| 2,330,699 | 9/1943 | Flamm | 294/87.26 |
| 2,792,146 | 5/1957 | Zastrow | 294/87.2 X |
| 2,823,062 | 2/1958 | Toensmeier | 294/87.2 |
| 2,823,063 | 2/1958 | Toensmeier | 294/87.2 |
| 3,097,010 | 7/1963 | Silver | 294/87.2 |
| 3,123,213 | 3/1964 | Kulig | 206/158 |
| 3,281,180 | 10/1966 | Spery | 294/87.2 |
| 3,528,697 | 9/1970 | Wood | 294/87.2 |
| 3,612,266 | 10/1971 | Graser | 294/87.2 X |
| 3,640,563 | 2/1972 | Wood | 294/87.2 |
| 3,834,750 | 9/1974 | Gauntlett | 294/87.2 |
| 4,318,476 | 3/1982 | Wood et al. | 206/459.5 |
| 4,401,212 | 8/1983 | Fischer | 206/158 |
| 5,135,104 | 8/1992 | Jorba | 206/151 |
| 5,320,216 | 6/1994 | Pangborn | 206/158 |

FOREIGN PATENT DOCUMENTS

| | | |
|---|---|---|
| 0172932 | 3/1986 | European Pat. Off. . |
| 2098585 | 3/1972 | France . |
| 2154197 | 9/1985 | United Kingdom . |

*Primary Examiner*—Johnny D. Cherry
*Attorney, Agent, or Firm*—Tsugihiko Suzuki

[57] ABSTRACT

An article carrier for holding together a plurality of articles such as bottles. The carrier comprises opposed upper and lower walls interconnected by spaced side walls. Each of the upper and lower walls has a plurality of article receiving apertures. The carrier has a billbroad panel depending from one of the side walls and an internal partition structure connecting the upper and lower walls. The partition structure comprises a pair of mutually hinged panel elements disposed in face to face contacting relationship.

8 Claims, 2 Drawing Sheets

TOP GRIPPING ARTICLE CARRIER

BACKGROUND OF THE INVENTION

This invention relates to an article carrier of the so called top gripping type which is particularly, although not exclusively, suitable for holding together a plurality of bottles at the neck portions of the bottles in two or more rows.

Top gripping carriers for bottles are well known. For example, U.S. Pat. No. 2,823,063 discloses a top engaging carrier having an internal double ply reinforcing partition. One of the partition-forming panels has a glue flap that extends from the bottom wall and is attached to the top wall of the carrier.

U.S. Pat. No. 4,318,476 discloses a top-engaging carrier having a so called billboard panel depending from one of the side walls. The billboard panel is normally used for carrying sales information and/or for advertising. In blank form, the carrier has its billboard panel at one end of the blank.

U.S. Pat. No. 5,135,104 discloses a top engaging carrier having a billboard panel and an upstanding reinforcing structure formed from a pair of mutually hinged panels. When the carrier is in blank form, the hinged panels are located between a pair of wall-forming panels.

Accordingly, so called billboard panels per se or partitions per se are known in the art as is shown in the above references. However, none of the references alone or in combination suggest forming a partition from a pair of hinged panels for the purpose of providing a top engaging carrier with a partition together with a billboard panel.

SUMMARY OF THE INVENTION

One aspect of the present invention provides an article carrier for holding together a plurality of articles such as bottles. The carrier comprises opposed upper and lower walls interconnected by spaced side walls to form a tubular structure. The lower wall includes a pair of wall-forming panel portions connected respectively to the side walls and disposed adjacent to each other. The upper and lower walls each has a plurality of article receiving apertures. The apertures in the lower wall are in register with apertures in the upper wall. The carrier also has a billboard panel depending from one of the side walls and an internal partition structure interposed between the side walls and extending between the upper and lower walls. The partition structure is formed from material disposed and connecting between the wall-forming panel portions of the lower wall.

According to a feature of this aspect of the invention, the partition structure may comprise a pair of first and second interconnected panel elements foldably joined respectively to the wall-forming panel portions. The panel elements may be disposed in flat face contacting relationship with each other and provide an upstanding part of the partition structure when the carrier is in a set up condition. Preferably, the partition structure further comprises a third panel element foldably joined to the upper edge of one of the first and second panel elements. Such a third panel element is secured to the upper wall.

According to another feature of this aspect of the invention, one of the wall-forming panel portions may have an outer side edge disposed along the one side wall to which the billboard panel is joined, and the one wall-forming panel may be provided with a glue flap foldably joined thereto along the outer side edge of the one wall-forming panel portion. The glue flap is secured to the one side wall and thereby the one wall-forming panel is connected to the one side wall.

Another aspect of the invention provides a blank for forming an article carrier of a tubular structure suitable for holding together a plurality of articles such as bottles. The blank comprises a series of foldably interconnected wall panels for forming the tubular structure. The series of wall panels includes a pair of end panels located at the opposite ends of the blank. The blank also comprises a billboard panel foldably joined to one of the end panels. One of the wall panels comprises a pair of wall-forming panel portions and a pair of foldably joined panel elements disposed between the wall-forming panel portions to form a partition structure for dividing the internal space of the tubular structure. The panel elements are foldably joined respectively to the wall-forming panel portions.

According to a feature of this aspect of the invention, the series of wall panels may include a pair of upper and lower wall panels and a pair of side wall panels. The series of wall panels are disposed in the sequence of one of the side wall panels, the upper wall panel, the other side wall panel and the lower wall panel. The one side panel comprises the one end panel to which the billboard panel is joined, and the lower wall panel comprises the one wall panel which has the wall-forming panel portions and the panel elements.

DETAILED DESCRIPTION OF PREFERRED EMBODIMENT

Figure 2:
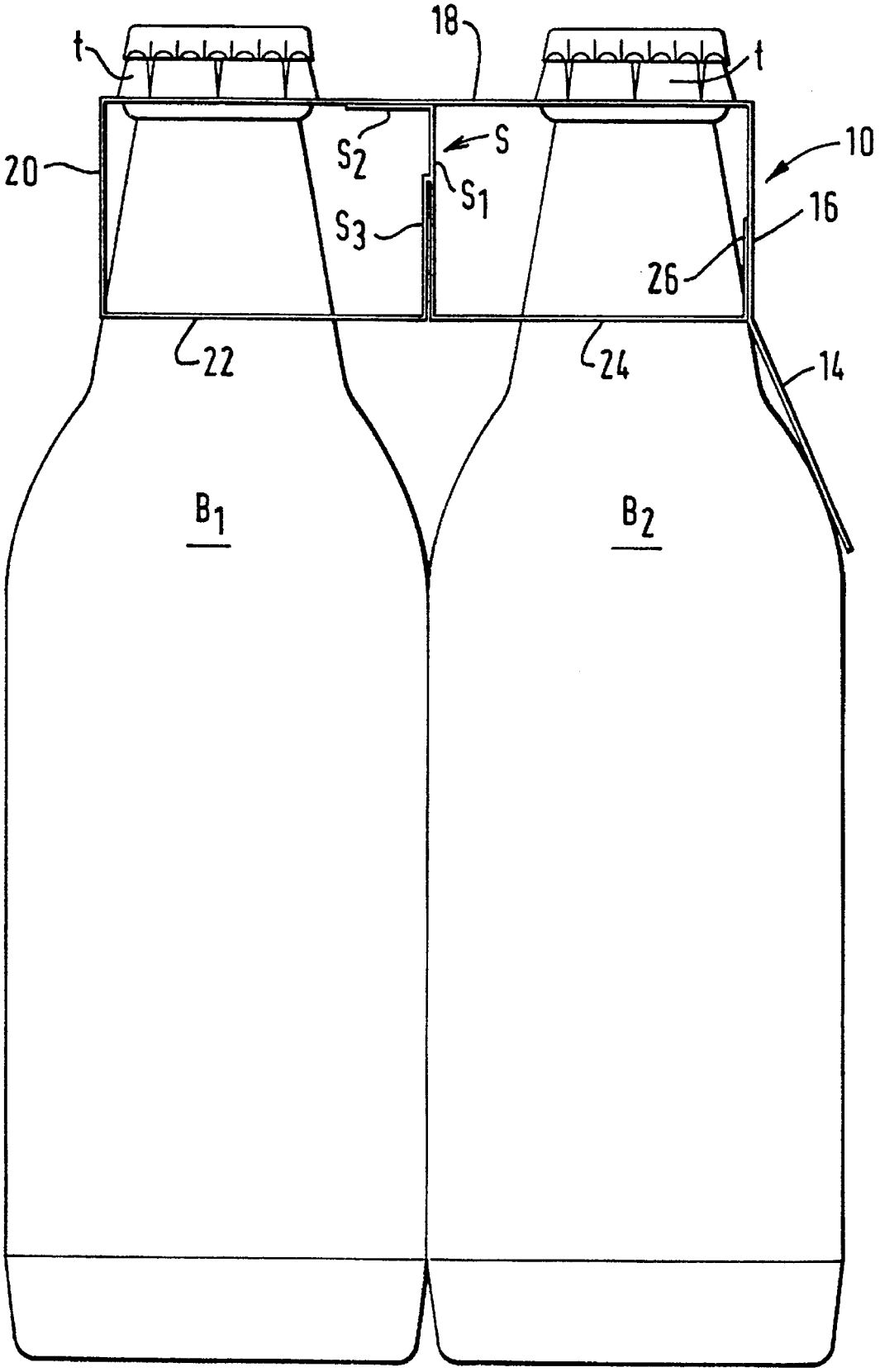
FIG. 2 is a schematic vertical cross-section of the article carrier showing it applied to a plurality of bottles.

Referring to the drawings, an article carrier 10 of the top gripping type is formed from a blank 12 of paper board or similar foldable sheet material, the blank comprising a series of panels hinged one to the next along transverse fold lines. Thus, the blank comprises a billboard panel 14, a first side wall panel 16, a top wall panel 18, and a second side wall panel 20, a first wall-forming panel portion 22, a composite partition structure S which comprises panel elements S1, S2, and S3, a second wall-forming panel portion 24 and a glue flap 26 hinged one to the next along transverse fold lines 28, 30, 32, 34, 36, 38, 40, 42 and 44 respectively. This particular article carrier is intended to be applied to a group of four bottles arranged in two rows of two bottles each as depicted in FIG. 2 by references B1 and B2, respectively. Thus, the top wall panel 18 includes an array of so called sun-burst apertures A1–A4 in which the upper neck portions of the bottles are to be received. As is known, such sunburst apertures each include an annular array of tabs "t" which engage beneath the rim of the crown cork or other top fastener of the bottle to secure the neck of the bottle in the carrier.

Each of the base panels 22 and 24 include a pair of apertures A5; A6 and A7; A8, respectively, which, when the carrier is put into its set up condition as shown in FIG. 2, are brought into register with respective pairs of the apertures in the top wall panel 18. In order to facilitate carrying the loaded carrier, the top wall panel 18 includes a finger hole H and the panel element S1 also includes a finger hole H1.

Figure 1:
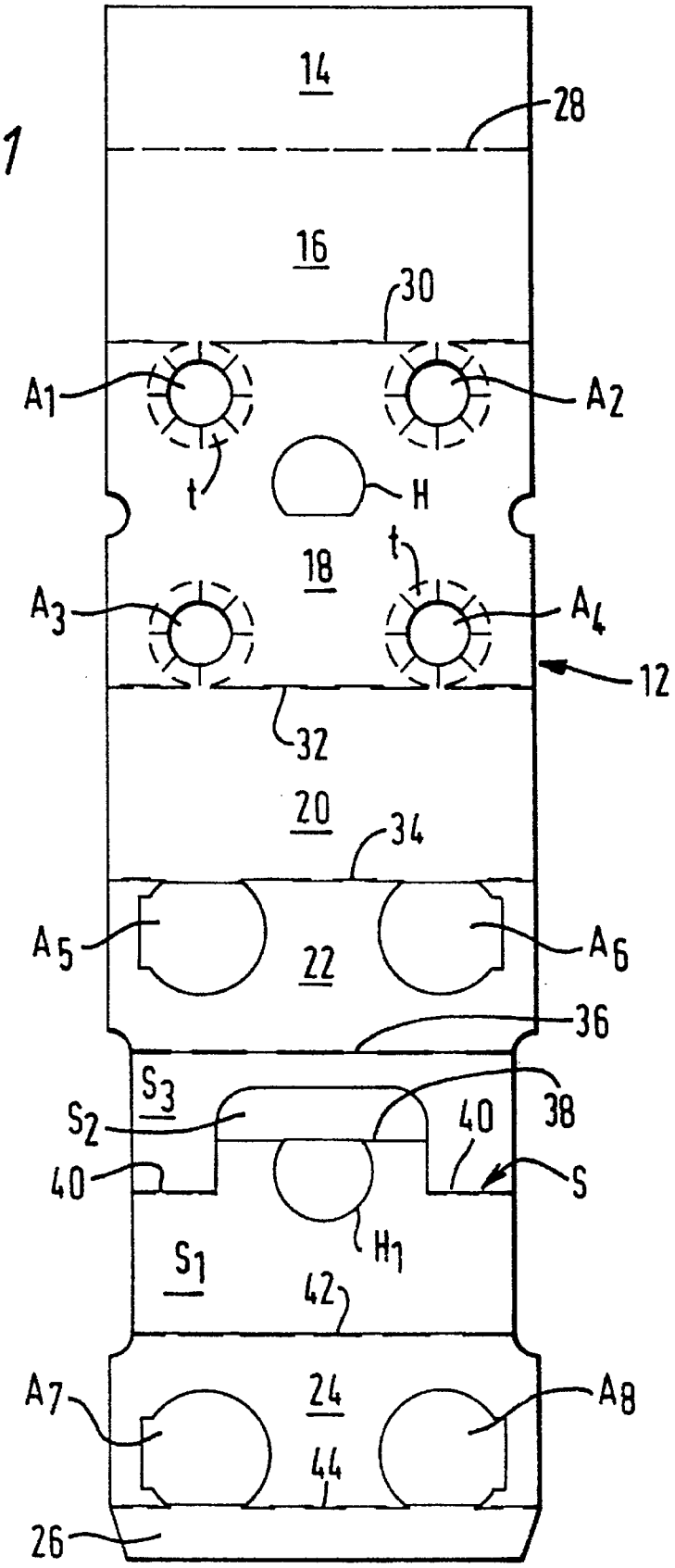
FIG. 1 is a plan view of a paper board blank from which an article carrier according to the invention is made.

In order to form the carrier from the blank shown in FIG. 1, the glue flap 26 is adhered to the lower portion of side wall panel 16 adjacent the billboard panel 14 and the partition structure S is set up so that the panel element S1 is upstanding parallel to the glue flap 26, the side wall 16 and the panel element S3. The panel element S2 is foldably joined to the uppermost edge of the panel element S1 and is folded through approximately 90° about fold line 38 and secured to the underside of the top panel 18. The panel element S3, which is foldably joined along interrupted fold line 40 to the panel element S1 on either side of the panel element S2, is folded downwardly through approximately 180° into face to face contacting relationship with the lower portion of the panel element S1. Hence, when the panel elements of the partition structure are set up, the two wall-forming panel portions 22 and 24, shown in FIG. 1 of the drawings, are brought together whereby the internal partition structure S is disposed between them.

When the carrier is in its set up condition as shown in FIG. 2, the billboard panel 14 is able to depend downwardly against the shoulders of one pair of bottles to provide a panel on which sales and/or advertising material can be displayed to view. The internal partition structure, which is of multiply form, is thus formed from material disposed intermediately between the ends of the blank but is strong enough to brace the carrier for use.

The carrier is able to fold into a flat collapsed condition for transport and supply in a direction to the left of the observer as viewed in FIG. 2 of the drawings.

I claim:

1. An article carrier for holding together a plurality of articles such as bottles, said carrier comprising:

opposed upper and lower walls interconnected by a pair of spaced side walls so as to form a tubular structure, said lower wall including a pair of wall-forming panel portions connected respectively to said side walls and disposed adjacent to each other;

a billboard panel depending from one of said side walls; and an internal partition structure interposed between said side walls and extending between said upper and lower walls, said partition structure being formed from material disposed and connecting between said wall-forming panel portions, wherein said partition structure comprises a pair of first and second interconnected panel elements foldably joined respectively to said wall-forming panel portions, said panel elements being disposed in flat face contacting relationship with each other and providing an upstanding part of said partition structure when said carrier is in a set up condition.

2. An article carrier according to claim 1, wherein said partition structure further comprises a third panel element foldably joined to an upper edge of one of said first and second panel elements, said third panel element being secured to said upper wall.

3. An article carrier according to claim 1, wherein said billboard panel is joined to a lower edge of said one side wall.

4. An article carrier according to claim 1, wherein each of said upper and lower walls has a plurality of article-receiving apertures, said apertures in said upper wall being disposed in register respectively with said apertures in said lower wall.

5. An article carrier for holding together a plurality of articles such as bottles, said carrier comprising:

opposed upper and lower walls interconnected by a pair of spaced side walls so as to form a tubular structure, said lower wall including a pair of wall-forming panel portions connected respectively to said side walls and disposed adjacent to each other;

a billboard panel depending from one of said side walls; and an internal partition structure interposed between said side walls and extending between said upper and lower walls, said partition structure being formed from material disposed and connecting between said wall-forming panel portions, wherein one of said wall-forming panel portions has an outer side edge disposed along said one side wall, said one wall-forming panel portion being provided with a glue flap foldably joined thereto along said outer side edge, said glue flap being secured to said one side wall whereby said one wall-forming panel portion is connected to said one side wall.

6. An article carrier according to claim 5, wherein said billboard panel is joined to a lower edge of said one side wall.

7. An article carrier according to claim 5, wherein each of said upper and lower walls has a plurality of article-receiving apertures, said apertures in said upper wall being disposed in register respectively with said apertures in said lower wall.

8. A blank for forming an article carrier of a tubular structure suitable for holding together a plurality of articles such as bottles, said blank comprising:

a series of foldably interconnected wall panels for forming said tubular structure, said series of said wall panels including a pair of end panels located at the opposite ends of said blank; and a billboard panel foldably joined to one of said end panels, one of said wall panels comprising a pair of wall-forming panel portions and a pair of foldably joined panel elements disposed between said wall-forming panel portions to form a partition structure for dividing an internal space of said tubular structure, said panel elements being foldably joined respectively to said wall-forming panel portions, said series of said wall panels comprising a pair of upper and lower wall panels and a pair of side wall panels, said series of said wall panels being disposed in the sequence of one of said side wall panels, said upper wall panel, the other side wall panel and said lower wall panel, said one side panel comprising said one end panel to which said billboard panel is joined, said lower wall panel comprising said one wall panel which has said wall-forming panel portions and said panel elements, wherein one of said wall-forming panel portions is foldably joined to said other side wall panel, the other wall-forming panel portion provides a free edge of said lower wall panel, and a glue flap is foldably joined to said other wall-forming panel portion along said free edge of said lower wall panel.

* * * * *